United States Patent [19]

Fontanille

[11] Patent Number: 4,597,535

[45] Date of Patent: Jul. 1, 1986

[54] METHOD AND APPARATUS FOR REGULATING THE OPERATION OF A CRUSHER

[75] Inventor: Daniel Fontanille, Rambouillet, France

[73] Assignee: Stein Industrie, Velizy-Villacoublay, France

[21] Appl. No.: 388,816

[22] Filed: Jun. 16, 1982

[30] Foreign Application Priority Data

May 3, 1982 [FR] France ..... 82 07631

[51] Int. Cl.[4] ..... B02C 25/00

[52] U.S. Cl. ..... 241/30; 241/34; 241/35

[58] Field of Search ..... 241/26, 30, 34, 80, 241/97, 171, 33, 37, 35

[56] References Cited

U.S. PATENT DOCUMENTS 2,381,351 8/1945 Hardinge .
3,157,365 11/1964 Brown et al. .
3,314,614 4/1967 Daniel et al. ..... 241/30
3,417,927 12/1968 Crocker et al. ..... 241/35 X

FOREIGN PATENT DOCUMENTS 1549934 of 0000 France .
1361418 of 0000 United Kingdom .
1088144 of 0000 United Kingdom .

OTHER PUBLICATIONS

"Controlling the Output of a Ball Mill", R. Schulz Zement-Kalk-Gips, 66, No. 2, Feb. 1977, pp. 49-52.

*Primary Examiner*—Howard N. Goldberg
*Assistant Examiner*—Joseph M. Gorski
*Attorney, Agent, or Firm*—Sughrue, Mion, Zinn Macpeak & Seas

[57] ABSTRACT

A method of regulating the operation of a material-crusher (1) in which the noise emitted by the crusher, the power absorbed thereby and the supply and removal flow rates of the material therein are detected. The flow rate (2) of the material fed into the crusher is regulated so as to maintain the quantity of material therein at a high and constant value close to that at which the efficiency of the crusher is at its best.

2 Claims, 1 Drawing Figure

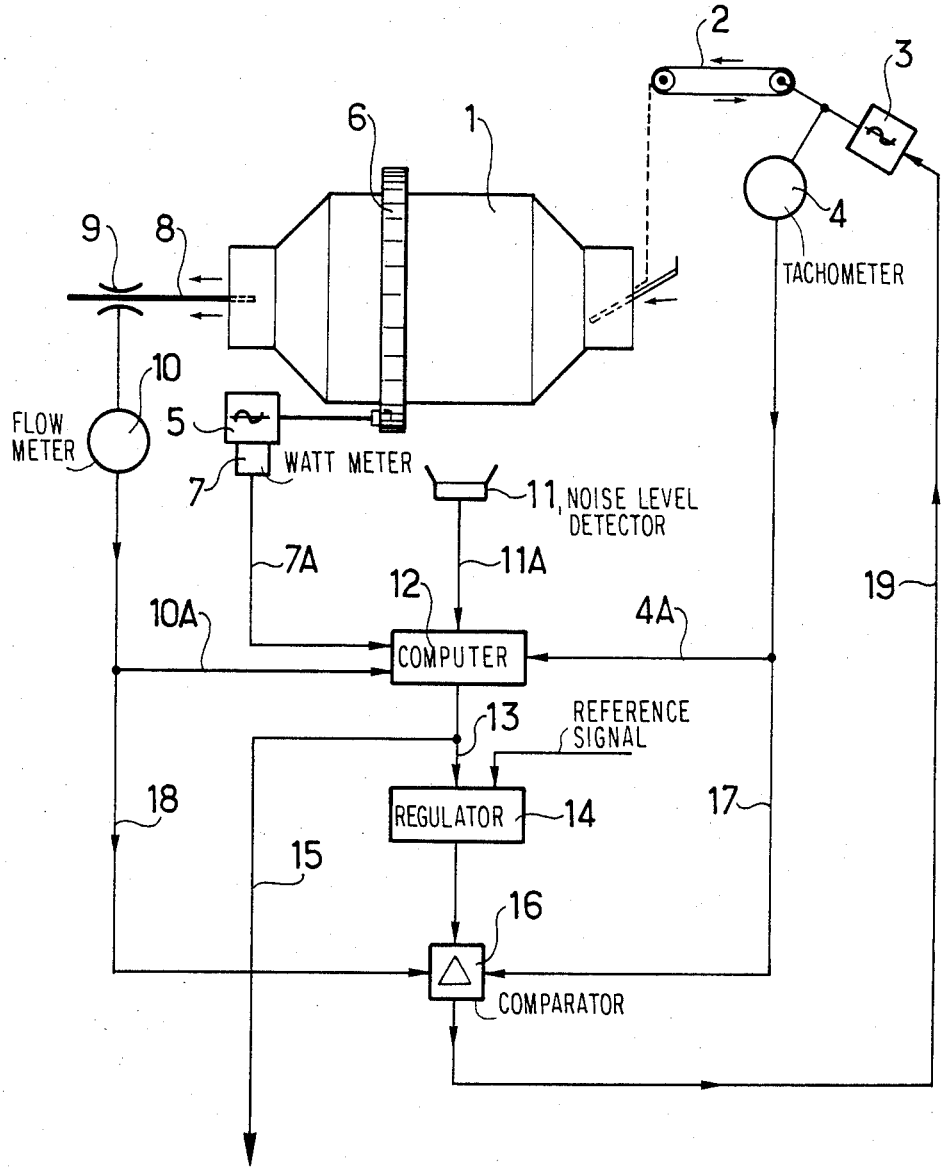
2
3
6
1
4
TACHOMETER
9
8
10
FLOW METER
5
WATT METER
7
11, NOISE LEVEL DETECTOR
7A
11A
12
19
10A
4A
COMPUTER
13
REFERENCE SIGNAL
18
REGULATOR
14
17
15
16
COMPARATOR

METHOD AND APPARATUS FOR REGULATING THE OPERATION OF A CRUSHER

The present invention relates to a method of regulating the operation of a material crusher in which the noise emitted by the crusher, the power absorbed thereby and the material supply and removal flow rates are detected. It also relates to apparatus for putting said method into practice.

BACKGROUND OF THE INVENTION

The Applicant's French patent FR-A-No. 2140782 relates to a regulator apparatus of this kind which has one or more sensor units for one or more variables related to the load flow rate, in particular noise generated by the apparatus, together with means for maintaining the load flow rate at a predetermined value as a function of the readings of the sensor unit.

Indeed, it is known that noise generated by a crusher is very loud when the crusher is almost empty and decreases very rapidly as the material to be crushed is fed in, and then tends asymptotically towards a minimum value. By regulating the crusher to a low noise level, a zone of operation is obtained in which the power consumed decreases as the quantity of material being crushed increases and the efficiency of the crusher is high.

However, regulating the load flow rate does not necessarily give the best operating conditions when the properties of the material to be crushed (grain size, friability, dampness, etc) are variable. In such a case, there is a danger of not obtaining optimum efficiency nor constant quality of the crushed material which may then be sometimes insufficiently crushed or on the contrary it may be excessively crushed.

The present invention aims to remedy these drawbacks and to provide a method and apparatus for regulating the operation of a crusher which is not very sensitive to the modifications in properties of the material to be crushed and which crushes constantly with an efficiency close to the optimum value.

It also aims to avoid the crusher clogging by too much material to be crushed being let in, to reduce the wear of the crushing units as a function of the crushed material flow rate to a substantially minimum value, to make the crusher operate at a loading zone where it is the quietest, and to give it some degree of autonomy of operation in the case of momentary stoppage in the feed.

SUMMARY OF THE INVENTION

In the method of the invention the flow rate of the material feed into said crusher is regulated as a function of these variable factors so as to maintain the quantity of material therein at a high and constant value close to that at which the efficiency of the crusher is at it best.

Preferably, the quantity of material in the crusher is approximately regulated in a rapid manner and is more finely regulated more slowly as a function of the noise emitted and of the power consumed by the crusher, depending on the flow rate of the material entering and leaving the crusher.

The apparatus according to the invention includes a sensor for sensing the noise emitted by the crusher, a sensor for sensing the power absorbed thereby, a sensor for sensing the flow rate of material inserted in the crusher, a sensor for sensing the flow rate of crushed material being removed from the crusher and a motor for adjusting the flow rate of material inserted in the crusher, wherein said apparatus further includes a computer which weights the readings from the sensors to form an overall signal giving the quantity of material in the crusher, a regulator which gives a correction signal as a function of the overall signal from the computer and a reference signal, and a comparator which gives said motor for regulating the flow rate of material inserted a correction signal as a function of the regulator correction signal and of the flow rates of the material entering and leaving the crusher.

BRIEF DESCRIPTION OF THE DRAWING

An apparatus for regulating the operation of a ball mill in accordance with the invention for crushing coal is described hereinafter by way of example and with reference to the single schematic diagram FIGURE of the accompanying drawing.

MORE DETAILED DESCRIPTION

In FIG. 1, the ball mill 1 has a closed rotating vat with a horizontal axis and is supplied by a conveyor belt 2 with coal to be crushed. The conveyor belt has drive rolls driven by an electric motor 3 whose speed is detected by a tachometer 4. The ball mill is rotated by an electric motor 5 via a gear meshed with a toothed crown wheel 6. The power absorbed by the motor 5 is detected by a wattmeter 7.

A diaphragm 9 in a schematically illustrated pipe 8 for removing coal dust makes it possible to measure the flow rate of air which entrains said coal dust, said flow rate being measured by a flowmeter 10.

Further, a unit 11 herein referred to as an electric ear and used to detect the level of noise generated by the crusher is connected to a computer 12 by the connection 11A which also receives the reading from said conveyor belt tachometer 4 via a connection 4A, the reading of the power absorbed measured by the wattmeter 7 via a connection 7A, and the flow rate of coal dust removed, as read by the flowmeter 10 via a connection 10A. It weights these various indications and derives therefrom a correction signal which it transmits firstly via a circuit 13 to a regulator 14 and secondly via a circuit 15 to units which display the power consumed and the quantity of coal in the crusher.

The regulator 14 compares the reading of the quantity of coal in the crusher as transmitted by the computer 12 with a reference value and derives therefrom a correction signal which it transmits to a comparator 16 which also receives the reading from the tachometer 4 via a circuit 17, said reading being representative of the rate of supply of material to be crushed, and the reading from the flowmeter 10 via a circuit 18, said reading being representative of the flow rate of the crushed material removed. It derives a correction signal to correct the coal supply flow rate of the crusher, said signal generating a rapid but approximate correction if it comes from the comparison between the supply and removal flow rates and a slower but more precise correction if it comes from the regulator 14. The correction signal is transmitted by a circuit 19 to the motor 3 which drives said conveyor belt.

Although the apparatus which has just been described with reference to the FIGURE of the drawing appears to be the preferred embodiment of the invention, it will be understood that various modifications can be made thereto without thereby going beyond the scope of the invention, it being possible to replace some of its components by others which could perform an analogous technical function. In particular, it could be linked to sensors of variable factors related to the properties of the material which is to be crushed. It could be used with numerous materials to be crushed other than coal.

I claim:

1. A method of regulating the operation of a material crusher energized by electrical power having an amount of material fed thereto for crushing and withdrawal therefrom at given material supply and removal flow rates by powering said crusher, said crusher emitting noise while under powered operation, said method comprising the steps of:

comparing the material supply and removal flow rates of incoming and withdrawn material, detecting said noise emitted by the crusher, said electrical power absorbed thereby and the material supply and removal flow rates, and providing a rapid, rough regulation of said amount of material fed into said crusher by controlling the flow rate of the material fed into the crusher according to a comparison between the flow rates of the incoming and withdranw material, and providing a fine, slow regulation of the material fed into the crusher by regulating the flow rate of the material fed into the crusher according to the comparison between the flow rates of the incoming and withdrawn material, and according to the emitted noise and power consumed by the crusher.

2. Apparatus for regulating the operation of a material-crusher having an amount of material fed thereto for crushing and withdrawal therefrom at given flow rates by powering said crusher, said crusher emitting noise while under powered operation, said apparatus including:

a sensor for sensing said noise emitted by the crusher, a sensor for sensing the power absorbed thereby, a sensor for sensing the flow rate of material fed into the crusher, a sensor for sensing the flow rate of crushed material being removed from the crusher, means for inserting material into the crusher at a variable flow rate including a motor for adjusting the flow rate of material fed to the crusher, means for removing crushed material from the crusher at a variable flow rate, and wherein said apparatus further includes a computer, means coupling said computer to said sensors, and said computer including means for weighting readings from the sensors and means for forming an overall signal giving said amount of material in the crusher, a regulator connected to said computer for supplying a correction signal as a function of the overall signal from the computer and a reference signal, and a comparator connected to said computer for supplying to said motor a correction signal for regulating the flow rate of material inserted into the crusher as a function of the regulator correction signal and means for directly conecting said comparator to said sensor for sensing the flow rates of the material entering and leaving the crusher.

* * * * *